United States Patent [19]

Lui et al.

[11] 4,121,810

[45] Oct. 24, 1978

[54] ALUMINIUM DROSS TREATMENT APPARATUS

[75] Inventors: Ming-Wah Lui; Yung-Shu Wang, both of Kowloon, Hong Kong

[73] Assignee: Meyer Aluminium Ltd., Kowloon, Hong Kong

[21] Appl. No.: 818,129

[22] Filed: Jul. 22, 1977

[51] Int. Cl.[2] ..... C22B 21/00

[52] U.S. Cl. ..... 266/201; 366/329; 366/331; 266/227; 266/235

[58] Field of Search ..... 75/24, 61, 68 R, 93 AC; 266/200, 201, 227, 232, 235, 240, 275, 276; 209/203, 205, 296, 450, 463, 465; 210/84, 528, 532 R; 366/314, 327, 329, 331

[56] References Cited

U.S. PATENT DOCUMENTS

| | | | |
|---|---|---|---|
| 862,008 | 7/1907 | Nebel | 266/232 |
| 1,183,885 | 5/1916 | Landis | 366/314 |
| 1,866,668 | 7/1932 | Protzeller et al. | 266/276 |
| 2,154,339 | 4/1939 | Lawrence | 210/532 R |
| 2,224,501 | 12/1940 | Cooper | 266/235 |
| 2,930,596 | 3/1960 | Waters | 366/314 |
| 3,263,969 | 8/1966 | Frank | 366/314 |

FOREIGN PATENT DOCUMENTS

| | | | |
|---|---|---|---|
| 17,386 of | 1898 | United Kingdom | 209/205 |

*Primary Examiner*—Gerald A. Dost

*Attorney, Agent, or Firm*—Wood, Herron & Evans

[57] ABSTRACT

An aluminium/dross separator comprising a container or drum having one or more mixer blades mounted therein, drive means being provided to produce relative rotary movement of the container and blades characterized in that the drive means are positioned below and/or, to the side of, the container and do not extend over the top thereof.

9 Claims, 3 Drawing Figures

ALUMINIUM DROSS TREATMENT APPARATUS

This invention relates to aluminium dross treatment apparatus and equipment.

Producers of aluminium sheets require a large number of aluminium slabs as stock for use in rolling mills and the like. Such slabs are cast from aluminium which has been melted in a furnace. During the melting process aluminium drosses are formed on the surface of the melt in a variable quantity which can be up to about 20% of the weight of the aluminium metal. This dross consists of aluminium metal with about equivalent quantities of oxides, carbides, nitrides and the like.

It is clearly desirable to be able to recover as much aluminium metal from the dross, as possible.

It has been proposed to skim the dross from molten aluminium in a furnace and to feed it to a dross separator containing a number of rotating mixer blades which act to stir the dross so that the aluminium (and aluminium alloy) metal separates from the remainder of the dross and drains to the bottom of the container where it can be recovered. The waste dross can then be removed from the separator. However the mixer blades have been mounted on a shaft which is driven from above the separator resulting in an arrangement in which the vision of the operator is impeded, hindering the manipulation of the means for skimming the dross from the furnace and conveying it to the container.

An aluminium/dross separator in accordance with this invention comprises a container or drum having one or more mixer blades mounted therein, drive means being provided to produce relative rotary movement of the container and blades characterized in that the drive means are positioned below and/or to the side of the container and do not extend over the top thereof.

Whilst it might be possible to drive the container around stationary or counter-rotating mixer blades it is preferred to mount the blades on a vertically arranged shaft which shaft is mounted in upper and lower bearings and is driven by drive means located beneath the container, the lower bearing between the shaft and the container being shielded by an annular shield secured to the shaft at a location above an exit or drain for the separated metal, the shield extending down to a position adjacent the bottom of the container and encompassing both the bearing and a stationary member corresponding in shape to the shield, which member is secured to the base of the container or forms part thereof and carries or surrounds the bearing and extends up within the shield, a small annular space being left between the rotatable shield and corresponding stationary member.

The shield and corresponding member may be in the form of a 'double-bell', the lower 'bell' being in effect a part of the bottom of the drum and the lower bearing being positioned beneath its centre. The upper 'bell' or shield which corresponds in shape to the bottom bell is secured at its centre to the rotatable shaft. An appropriate annular space is provided between the two 'bells'.

The provision of such a shield avoids the difficulty of having to provide a sliding or rotatable seal to protect the bearing, which would wear in use or be damaged by the molten metal and abrasive drosses. With the arrangement in accordance with the invention, molten metal and abrasives cannot reach the bearing as in order to do so the metal would have to rise up within the space between the seal and the corresponding member to a level wall above that of the metal outlet from the container. The gap between the shield and corresponding member is made sufficiently small as to exclude particles of dross from passing between the said members.

The provision of a shielded bottom bearing enables the main shaft to be driven from beneath the container and hence enables the top of the separator to be unobstructed to allow the operator closely to see and to operate the dross skimming means without hinderance.

Preferably the seal and corresponding stationary member are both frusto-conical in shape extending outwardly from the shaft towards the bottom of the container.

In addition to the usual mixing blades the separator preferably has spiral paddles or the like which are secured to the shaft and to the shield and which on rotation tend to cause the mixture of the dross and the molten aluminium droplets to be raised up continuously within the container. This additional movement of the mixture helps to produce more thorough agitation leading to the recovery of most of the free aluminium metal.

The container is preferably carried by horizontally extending stub axles so that the container can be tipped up to remove the waste dross from the container at the end of each aluminium separating operation, stop and lock means preferably being provided to hold the drum in its normal vertical operating position as well as in its tipped position.

The drum or container is preferably mounted on a wheeled carriage so that it can readily be positioned to receive the skimmed dross mixture from a furnace or be wheeled away when not required.

The invention will now be further described by way of example with reference to the accompanying drawings in which.

Figure 1:
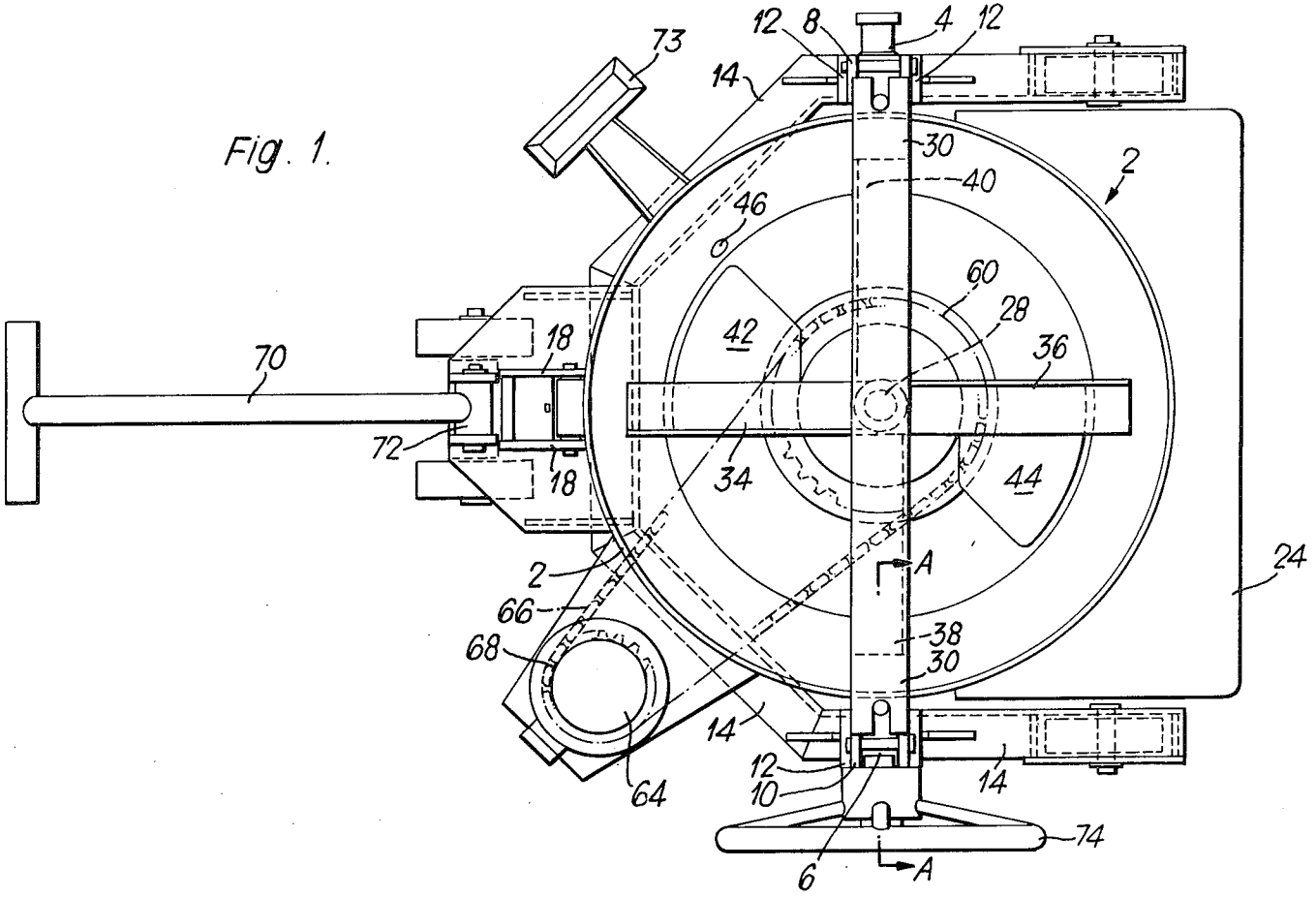
FIG. 1 is a plan view of one embodiment of aluminium/dross separator in accordance with the invention.

Referring to the drawing the separator comprises a drum 2 fitted with stub axles 4, 6 which are engaged in trunion bearings 8, 10 which are carried on posts 12 upstanding from a wheeled carriage generally indicated at 14.

The drum 2 has a downwardly extending lock member 16 provided with a pivotal latch lever 18, the hook 20 of which latches under a bar 22 secured to the carriage 14. Thus in the position shown in the drawing the drum is safely locked in the upright position but when it is to be tipped to discharge its contents the latch lever 18 is pivotted to disengage from the bar 22 and the drum may then be tipped about its horizontal axis, the axles 4, 6 rotating in their trunions so that the contents can be tipped from the drum over a lip 24 into a suitable receptacle.

A rotatable drive shaft 26 extends centrally up within the drum and is mounted in an upper bearing 28 carried on a member 30 extending across the top of the drum and in a lower bearing 32 carried by the bottom wall of the drum.

The shaft 26 carries several pairs of angularly pitched mixing blades 34, 36, 38, 40 and two paddles 42, 44 positioned adjacent the bottom of the drum beneath the blades, and being of the spiral propeller type. Rotation of the main shaft 26 causes the blades 34–40 and paddles 42, 44 to rotate thoroughly to agitate the dross mixture contained in the drum to cause separation of molten metal from waste dross.

Molten aluminium metal separated from the waste dross finally falls to the bottom of the drum to exit from a bottom tapping hole 46 (see FIG. 1) the bottom lining 48 of the drum which is of refractory material sloping towards the tapping hole 46 so as to ensure that the molten aluminium metal runs from the hole.

Figure 2:
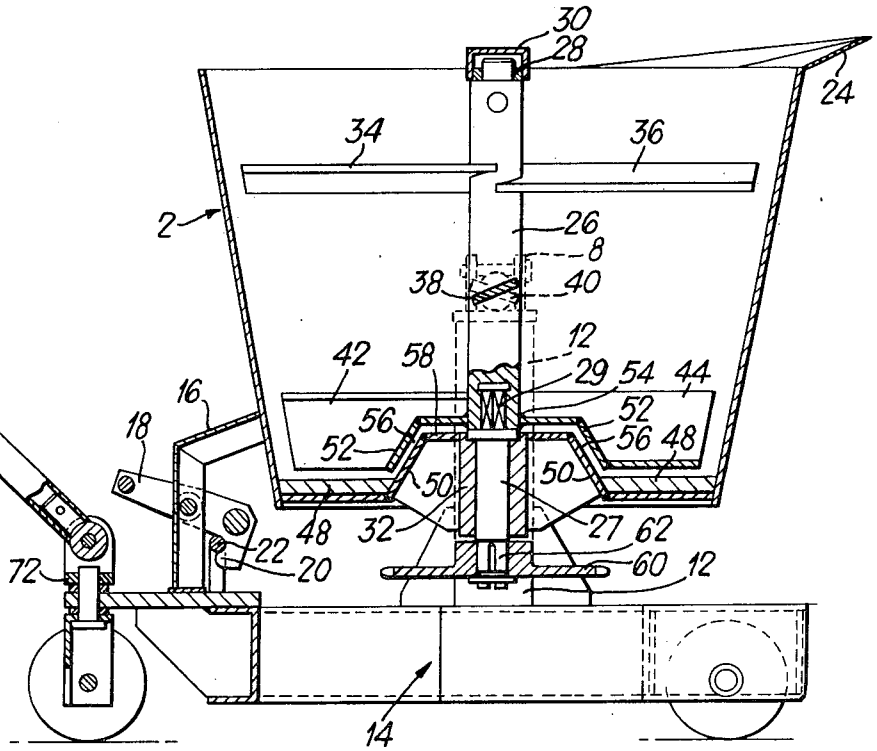
FIG. 2 is a cross-section of the separator shown in FIG. 1.

As can be seen clearly in FIG. 2 the bottom bearing 32 of the main shaft is mounted within a frusto-conical or bell-shaped stationary member 50 which extends up from the bottom plate or lining of the drum within a correspondingly shaped frusto-conical or bell-shaped shield 52 which is secured at 54 to the main shaft and surrounds the bearing 32. A small clearance 56 is left between the rotatable shield 52 and the stationary member 50. Thus the bearing 32 is shielded from the molten metal in the drum. Molten aluminium flowing over the sloping bottom lining of the drum normally exits from the tapping hole 46. If dross or molten metal does flow into the space 56 between the shield and stationary member it never reaches the height of the horizontal portions 58 of the shield and stationary member as with the tapping hole open, it would run from the hole before reaching that level.

In fact the space 56 is dimensioned to be much smaller than the dimensions of normal dross particles which are thus physically prevented from entering the space between the shield members.

It will thus be appreciated that the provision of the frusto-conical shield and corresponding stationary member provides a very simple and elegant means of shielding the bearing 32 allowing this to be located at the bottom of the drum and without there having to be provided any form of sliding or rotating seal which could be damaged in use. It will of course be appreciated that the members 50, 52 are separated and thus do not rub during rotation of the shaft and shield.

The provision of the bottom bearing enables the main shaft 26 or its lower extension member 27 to which the main shaft is connected by engagement of a square spigot 29 on the extension in a corresponding socket in the bottom of the main shaft, to be driven from beneath the drum through drive means comprising a chain sprocket 60 which is secured at 62 to the lower extension 27 of the main shaft 26. The chain sprocket 60 is driven by means of an electrical or air motor generally indicated at 64 (see FIG. 1) through a chain diagrammatically illustrated at 66 from a drive chain sprocket 68.

In operation the carriage 14 is pulled by means of a pivotally mounted handle 70 connected to a pivotally mounted front axle support 72, to a convenient position adjacent the operation door of an aluminium melting furnace. The flat chute 24 is fitted to the top of the drum and hooked beneath an inclined board of the door sill of the furnace to facilitate the continuous transfer of dross from the furnace to the drum.

As the container is charged and the aluminium separated from the dross in a position adjacent the furnace, the temperature of the charge may be readily maintained above the melting point of the metal and a continuous separation process can take place. The dross should also be maintained below a temperature of about 800° C. to prevent further oxidation. Once a charge of dross has been received in the drum, the rotating blades tend to stir the dross upwardly whilst gravity tends to pull it down towards the bottom of the drum. The combined stirring action of the blades 34–40 and 42, 44 results in the agglomeration of the liquidous particles of aluminium metal which are collected at the lower annular portion of the bottom of the drum and which then escape through the tapping hole 46 to be received in a shaped mould 73 for casting into ingots of slabs. The recovery of the metal is completed almost as fast as the dross is transferred into the drum, the drum being made sufficiently large to be able to receive all the dross created from any one operation of the furnace.

Figure 3:
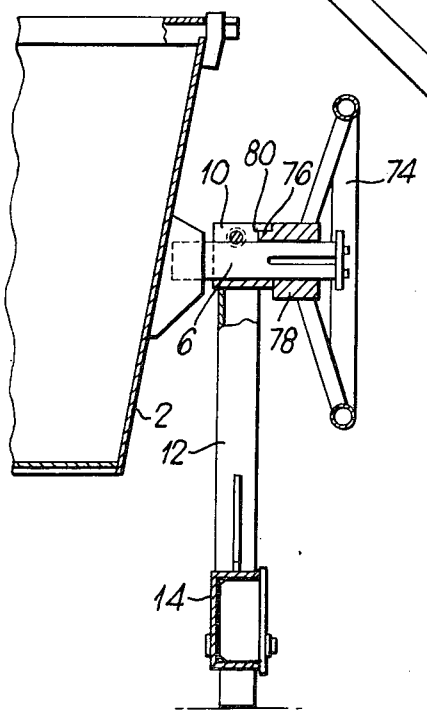
FIG. 3 is a section on the line A—A of FIG. 1.

When the molten aluminium has been discharged through the tapping hole 46 the waste dross material is discharged by tipping the drum about its trunion bearings 8, 10 by means of a hand wheel 74 slidably mounted on the stub axle 6, a lock or clutch comprising a tongue 76 (see FIG. 3) on the hub 78 of wheel 74 and a corresponding jaw or recess 80, being provided to hold the drum in a tilted position during discharge. The wheel 74 may be pulled out relatively to the drum to free the tongue 76 from jaw or recess 80 allowing the wheel to be rotated. On pushing the wheel back towards the container the tongue re-engages the jaw or recess at the top of the trunion to lock the container in the tipped position.

The main shaft may be lifted from its lower extension 27 and from the container for cleaning, carrying with it the blades 34–44 and the shield member 52.

As the drum is driven from beneath, the top of the drum can be unobstructed allowing an operator to have an unobstructed view during transfer of the dross from the furnace and for operation of the dross skimming means.

What we claim is:

1. An aluminum/dross separator apparatus comprising a container, said container defining an outlet adjacent the floor thereof for draining separated liquid aluminum from said container, at least one mixer blade inside said container, said blade being mounted on a vertically arranged rotatable shaft, upper and lower bearings for said shaft, drive means located beneath said container for rotating said shaft and blade relative to said container, an annular shield for said lower bearing secured to said shaft at a location vertically above said outlet, said shield extending down to a position adjacent the floor of said container, and said shield being positioned to encompass said lower bearing, and an annular stationary member corresponding in shape to said shield, said stationary member being secured to and upstanding from said floor of said container, said stationary member supporting said lower bearing, and said shield and said stationary member being spaced one from another so as to define a nominal clearance between said shield and said stationary member, said clearance being such as to prevent dross from passing therethrough but being such as to not hinder rotation of said shaft relative to said container.

2. An aluminum/dross separator apparatus as claimed in claim 1, the lower end of said shaft extending down through said lower bearing out from said floor of the container, said apparatus further comprising a drive sprocket fixed to said lower end of said shaft.

3. An aluminum/dross separator apparatus as claimed in claim 1, said apparatus further comprising at least two pairs of mixing blades located in the top region of said container, and a spiral paddle located adjacent the floor of said container.

4. An aluminum/dross separator apparatus as claimed in claim 1, said apparatus further comprising supporting framework and horizontally extending stub axles attached to said container, said framework and stub axles cooperating to permit said container to be tipped to remove waste dross.

5. An aluminum/dross separator apparatus as claimed in claim 4, said apparatus further comprising lock means to hold said container in its normal upright position and to hold said container in a tipped position.

6. An aluminum/dross separator apparatus as claimed in claim 1, said apparatus further comprising a wheeled carriage on which said container is mounted.

7. An aluminum/dross separator apparatus as claimed in claim 1, said main shaft and said mixer blade being removable from said container for cleaning.

8. An aluminum/dross separator apparatus as claimed in claim 7, said main shaft being connected to a shaft extension which extends through said lower bearing, the connection between said shaft and said extension being such that said main shaft can be lifted off said extension, said main shaft carrying with it said annular shield member for said lower bearing when lifted off said extension.

9. An aluminum/dross separator apparatus as claimed in claim 1, said apparatus further comprising an extension on the lower end of said shaft, said extension extending down through said lower bearing out from said floor of said container, and a drive sprocket fixed to said extension.

* * * * *